US006463720B1

(12) United States Patent
Cherney et al.

(10) Patent No.: US 6,463,720 B1
(45) Date of Patent: Oct. 15, 2002

(54) METHOD AND APPARATUS FOR SETTLING PRODUCT IN A SERVO-CONTROLLED CONTINUOUS PULL SYSTEM

(75) Inventors: Dale M. Cherney, Howards Grove, WI (US); Larence Calvin Dobbs, Greer, SC (US)

(73) Assignee: Hayssen, Inc., Duncan, SC (US)

( * ) Notice: Subject to any disclaimer, the term of this patent is extended or adjusted under 35 U.S.C. 154(b) by 0 days.

(21) Appl. No.: 09/563,280

(22) Filed: May 3, 2000

Related U.S. Application Data

(63) Continuation-in-part of application No. 09/409,540, filed on Sep. 30, 1999, now abandoned.

(51) Int. Cl.[7] ..... B65B 1/22; B65B 9/06

(52) U.S. Cl. ..... 53/437; 53/451; 53/525; 53/551

(58) Field of Search ..... 53/437, 451, 525, 53/551; 318/114, 460

(56) References Cited

U.S. PATENT DOCUMENTS

| | | | | | |
|---|---|---|---|---|---|
| 4,827,679 | A | * | 5/1989 | Ross | 53/525 |
| 5,125,213 | A | * | 6/1992 | Focke | 53/437 |
| 5,235,794 | A | * | 8/1993 | Center | 53/525 |
| 5,485,712 | A | * | 1/1996 | Cherney | 53/525 |
| 5,724,792 | A | * | 3/1998 | Domke | 53/551 |

* cited by examiner

*Primary Examiner*—John Sipos
(74) *Attorney, Agent, or Firm*—Lee, Mann, Smith, McWilliams, Sweeney & Ohlson

(57) ABSTRACT

A method and apparatus for settling product in a servo-controlled vertical form, fill and seal machine where the product, when inserted into a partially-formed tubular bag, normally does not adequately settle without further action by the machine. The invention utilizes motion control of a servo motor to provide a settling action for product inside the partially-formed bag to introduce instability to cause settling in the bag at a very high frequency during continuous motion of the film and the film tube.

16 Claims, 4 Drawing Sheets

34
32
20
54
56

34
58
32
20
54
56

34
58
32
20
54
56

58
32
20
54
56

METHOD AND APPARATUS FOR SETTLING PRODUCT IN A SERVO-CONTROLLED CONTINUOUS PULL SYSTEM

RELATED APPLICATION

This application is a continuation-in-part of U.S. Pat. Ser. No. 09/409,540, filed Sep. 30, 1999 now abandoned.

BACKGROUND OF THE INVENTION

This invention relates to vertical form, fill and seal machines and in particular to settling of product within a partially-formed package or bag in a continuous motion vertical form, fill and seal bag making machine.

For many years, manufacturers of vertical form, fill and seal machines have been concerned about seal quality. This is particularly important in the end seal area where a transverse seal is formed across the bag. In this seal area, there is the possibility for product to be trapped between the surfaces of the inside of the partially formed tube by sealing jaws when the jaws close to complete the seal. The trapped product keeps the film surfaces from achieving intimate contact for sealing, and the result is an open or partially open package. While this is a serious problem at any time, it is a particularly serious problem when the product being sealed by the machine is a food product subject to spoilage or contamination. When the package is to contain an inert gas for preservation of the product therewithin, it is extremely important that there be a complete hermetic seal.

One major cause of having product trapped in the seal area is the inability of the machine to settle product in the bag prior to closing the sealing jaws. Thus, stripping in the seal area has been developed, and many stripping devices have been developed over the years to ensure the product is not trapped in the seal area between the sealing jaws. However, if the product is fragile, conventional methods of stripping often are not acceptable, particularly if breakage of the product is of concern or the product does not stack without a considerable amount of void areas.

Therefore, many shaking devices have evolved over the years to avoid the mechanical problems and product breakage inherent in customary forms of stripping. The earliest of these devices was based on the concept of clamping a movable shaking device to the bag in a position over the product in the bag. After the bag pull has been completed and before the sealing jaws close, the shaker device, located above the sealing jaws, closes on the film over the unsettled product. Once closed, the shaking device raises and lowers the bag several times with adjustable amplitude and frequency to shake the bag and the product contained within the partially-formed bag in order to settle the product below the plane of the sealing jaws.

A major objection to this type of settling device is the amount of time it takes to clamp the bag and shake the bag prior to initiating the end seal. Thus, such a device is normally unusable in a high speed bag making process. In addition to the time requirement, there is also a possibility of bag deformation due to the clamping action of the shaker jaws on the film tube.

Another device developed for product settling has been a bag tamper, where rather than clamping to the bag, an exterior striking element is employed, impinging on the exterior of the bag, to strike the partially-completed bag and cause shaking in that manner. However, this device, in addition to being relatively slow to settle the product, also has the added disadvantage that striking the exterior of the tube can cause breakage of fragile product contained within the partially-formed bag, or deformation of the tube.

U.S. Pat. No. 5,485,712, assigned to the assignee of the present application, discloses a different means of product settling by actually reversing the direction of the film. The method and apparatus of this patent employs measuring rolls for metering the film, and pull belts for advancing the film after it has been formed into a tube. In accordance with one form of the patent, the film direction is reversed with the sealing jaws partially closed to provide a reverse stripping motion. In another form of the invention of the '712 patent, the method of achieving product settling involves driving the film in forward and reverse directions using a programmed time and frequency to achieve the desired product settling. While this type of settling can be achieved with either a servo-driven system or a stepper motor system, it also can be inherently slow because of the necessity to reverse directions several times in order to settle product within the partially-formed bag.

Further problems occur when the film does not stop, but operates what is called a continuous motion. In many of the previous shaking or stripping devices, it is necessary for the film to be stopped when the shaking or stripping occurs. When, however, the film is proceeding with a continuous motion mode of operation, such methods are unusable.

SUMMARY OF THE INVENTION

The invention comprises a method and apparatus of settling product in a vertical form, fill and seal machine. The machine comprises a source of film, a forming shoulder for forming the film into a tube, a pull axis for conveying the tube, and a finishing system for sealing and severing successive completed packages from the tube. The method according to the invention comprises the steps of operating the pull axis in a forward direction to continually pull the film. A desired portion of product is then injected into the tube as the tube continues to advance, and an instability is induced in the pull axis for a predetermined period of time to shake the tube and settle the product while the tube and the film continue to advance.

In accordance with the preferred form of the invention, after the predetermined period of time, the finishing system is then activated and follows the film at matched speed while a sealing operation is completed. Until then, the finishing system is not activated in order to permit product to be properly settled from the seal area between the sealing jaws. After sealing, the sealing jaws are returned for the next cycle of operation.

In accordance with a preferred form of the invention, the pull axis includes a servo motor for operating the axis, and the step of inducing the instability in the pull axis comprises setting the gain of the servo motor to induce oscillation. The proportional or P gain of the servo motor can be increased in order to increase the amplitude of the oscillation. The frequency of oscillation is determined by the dynamics of the system.

In the preferred form of the invention, a measuring roll axis is included for conveying the film from the source of film and for measuring a predetermined amount of the film. A pull belt axis is used to assist the film over a forming shoulder for forming the film into a tube. In this form of the invention, the step of inducing an instability comprises inducing an instability in the pull belt axis while leaving the gain adjustment in the measuring roll axis in a stable condition. Thus, instability is induced only in the pull belt axis, with the measuring roll axis being unaffected by the induced instability. Thus, control of the film can always be maintained in the measuring roll axis, with pulling of the tube over the forming shoulder and shaking of the tube occurring due to action in the pull belt axis. In this manner, the control of a registered film can always be maintained to provide high quality packages with end seals of high integrity.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
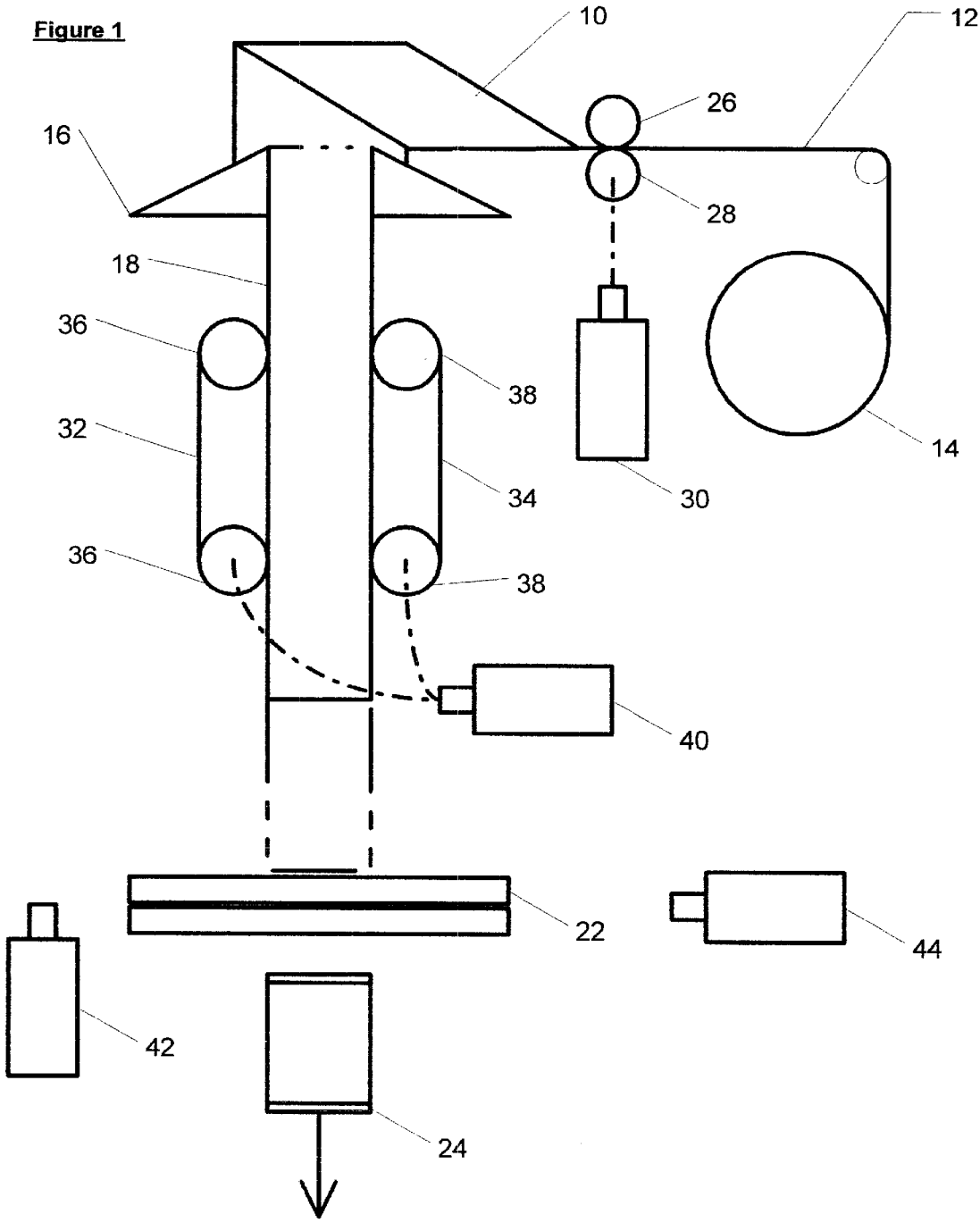
FIG. 1 is a schematic illustration of a vertical form, fill and seal machine employing the method and apparatus of the invention including a measuring roll axis, a pull belt axis, a sealing jaw axis and a sealing jaw travel axis.

FIG. 1 is a schematic view of a vertical form, fill and seal machine such as that depicted and described in U.S. Pat. Nos. 4,288,465; 4,391,081, 5,377,474 and 5,485,712, the disclosures of which are incorporated herein by reference. The vertical form, fill and seal machine is designated generally at 10, and includes a web 12 of flexible packaging material, such as a plastic film, that is pulled from a supply in the form of a roll 14. The film 12 is fed over a forming shoulder 16 into the form of a tube around a forming tube 18. Product to be packaged is provided and inserted through the forming tube 18 into a film tube 20 in a conventional fashion, and sealing is then performed by a sealing apparatus 22, resulting in successive sealed bags 24 being produced by the machine 10.

In the apparatus illustrated in FIG. 1, a measuring axis, comprising an upper measuring roll 26 and a lower measuring roll 28, is used for withdrawing a measured quantity of film 12 from the roll 14. The measuring rolls 26 and 28 are driven in concert by a prime mover 30, such as a servo motor or a stepper motor.

The tube 20 is pulled over the forming shoulder 16 under tension by a pull axis consisting of a pair of pull belts 32 and 34. As illustrated, the pull belt 32 is mounted around a pair of rollers 36, while the pull belt 34 is mounted around a pair of rollers 38. The pull belts 32 and 34 are driven by one or more prime movers 40, such as a servo motor or a stepper motor. FIG. 1 shows one prime mover 40 driving two pull belts 32 and 34, but two motors can be used to individually drive each pull belt 32 and 34, thus eliminating any need to link the two axes.

In this system, the film 12 is kept in constant motion, but typically with variable velocity during each bag making cycle. The bag making cycle begins with the sealing apparatus 22 in a retracted position with the film tube 20 extending between the sealing jaws. As the cycle begins, a jaw travel axis servo 44 begins to accelerate to match the speed of the advancing film tube 20. During this acceleration, a jaw close axis 42 begins to close the sealing jaws of the sealing apparatus 22 so that when the speed of the advancing film tube 20 is matched by the jaw travel axis 44, the sealing apparatus 22 closes on the film tube 20 to make end seals and sever the package 24 from the tube 18. Once the sealing operation has been completed, the jaw close axis 42 opens the sealing jaws of the sealing apparatus 22. When the jaws have opened sufficiently to clear the advancing product in the film tube 20, the jaw travel axis 42 begins the return travel of the sealing apparatus 22 to a fully retracted position, at which time the sealing cycle can begin anew.

Figure 3:
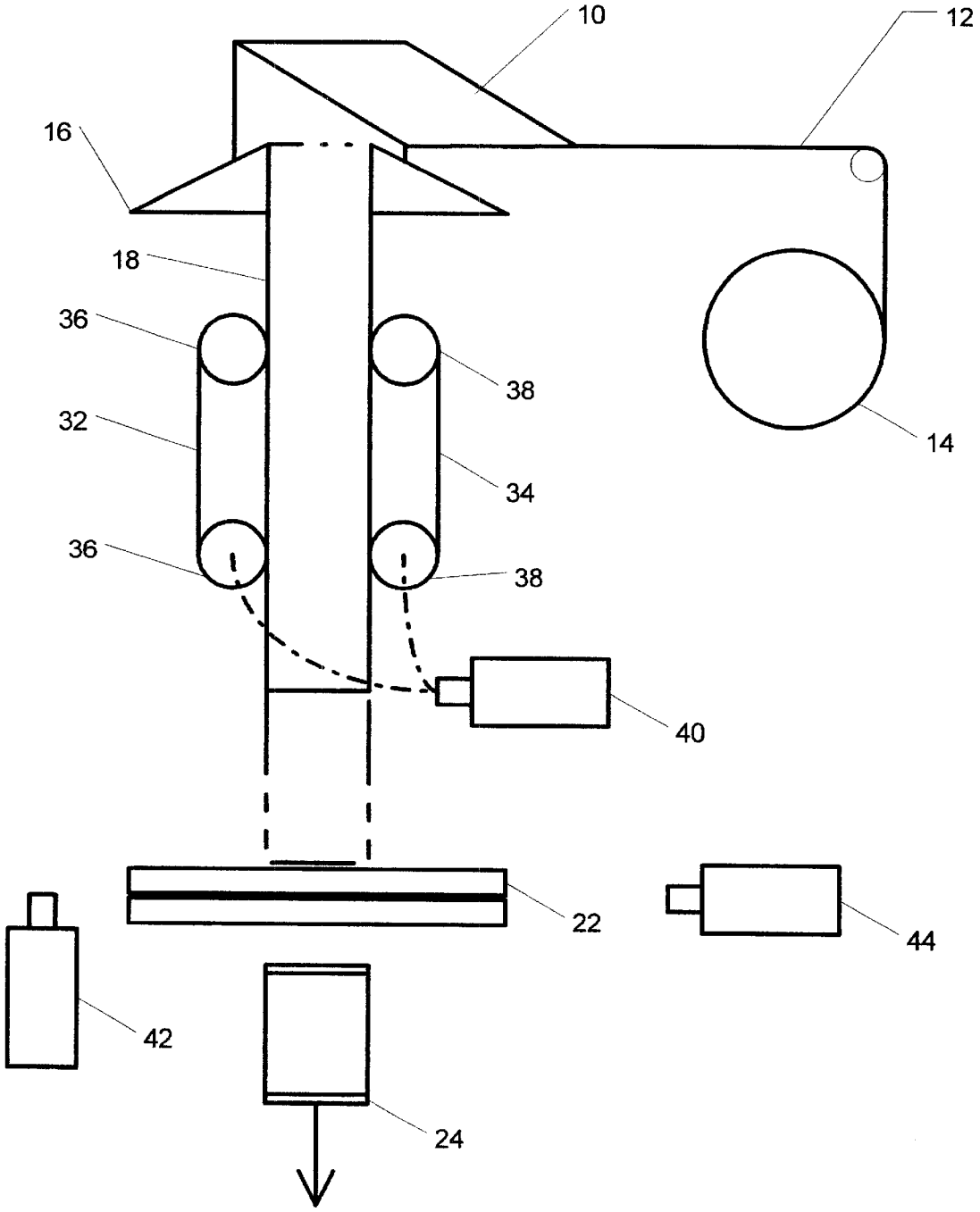
FIG. 3 is a schematic illustration of a second form of the invention using the pull belt axis alone to provide the film pull and product settling, and including an axis for closing the sealing jaws and an axis for moving the sealing jaws with the film.

FIG. 3 illustrates a similar system without the measuring rolls. In this embodiment, the pull belts control all film movement and settling of the product.

Figure 2:
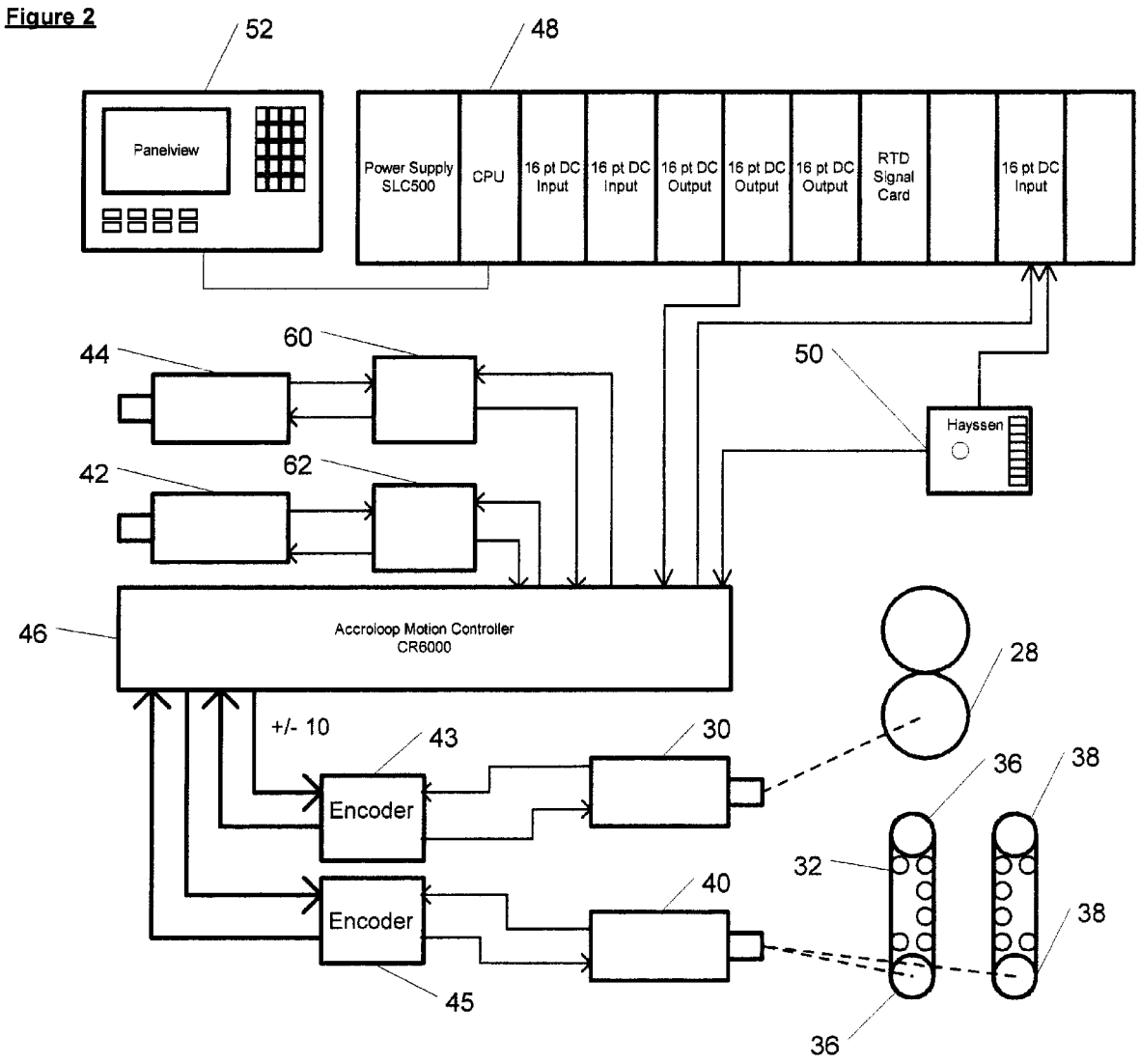
FIG. 2 is a block diagram of a servo control system for the machine of FIG. 1.

FIG. 2 illustrates a schematic plan of a typical control system used for control of a vertical form, fill and seal machine 10. For the sake of brevity, most elements of the machine 10 have been eliminated from FIG. 2.

In a servo motor system, each of the prime movers 30, 40, 42 and 44 is activated by a respective servo drive 43, 45, 62 and 60. The servo drives 43, 45, 62 and 60 are controlled by a motion controller 46 whose inputs are commanded movements from a PLC 48 or other similar device, such as a general purpose computer, and a registration mark read by an optical reader 50 reads an eye track on the film 12 as it passes under the optical reader. Further detail on the registration method can be found in U.S. Pat. No. 4,391,079, the disclosure of which is incorporated herein by reference. When two pull belt motors are used, two servo drives 45 would be employed, operated from the same command signal from the PLC 48. One motor would operate in the reverse direction of the other. The PLC 48 is controlled from a control panel 52. All of the elements illustrated in FIG. 2 can be conventional, and are therefore not described in greater detail.

As explained in incorporated U.S. Pat. No. 5,485,712 and illustrated in FIG. 1, while it is ideal to have the pull axis operating at the same linear velocity as the measuring axis, in most instances in actual operation there is belt slip between the pull belts 32, 34 and the film tube 20.

In that instance, eventually a loop in the film 12 will occur between the measuring rolls 26,28 and the pull belts 32, 34. This generates film tracking problems as well as registration errors in the ultimately formed bag 24.

In order to avoid these problems, the pull belts 36, 38 over-pull the film tube 20, and therefore the film 12, by an amount ranging up to five percent. This causes the pull belts 32, 34 to run faster than the measuring rolls 26,28 to maintain a desired tension between the measuring rolls and the pull belts. However, excessive amounts of over pull result in premature wear of the pull belts 32 and 34, and therefore over pull must be kept to a minimum. Another problem associated with excessive over pull can be registration errors and bag length errors.

In a servo-operated system as illustrated in FIGS. 1 and 2, the servo motors driving the measuring axis and the pull axis are driven to a commanded position by the servo drives 43 and 45. The preferred configuration of this combination has the pull belts following the measuring rolls. In this way, the commanded position move is given only to the master axis (measuring rolls 26, 28), and the slave axis (pull belts 32, 34) follows the commanded axis.

One of the key parameters for operating the servo motors is known as the proportional gain (P gain). The P gain is much like the volume control of a television or a radio, and the higher the P gain, the faster that the servo system responds, since the P gain directly affects the amount of energy which the drive can supply to the motor.

Servo motors are designed to seek a null condition. Therefore, the P gain must be adjusted to keep the system from oscillating, most importantly at zero velocity. If the P gain is set too high, the system over corrects, and must force itself back, at which time it again over corrects in the opposite direction, and a rapid, unstable oscillation occurs. The greater the P gain setting, the greater the amount of energy available for correction, and the greater the overshoot and resulting error. As a result, the P gain can be used to control the amount of oscillation allowed during the settling operation. The frequency of oscillation is generally governed by the mechanical constraints of the system.

In most conventional servo systems, oscillation of this type is extremely detrimental to both performance and longevity of components. This instability causes a jitter or shake in the servo motor, and, if occurring long enough, overheating of the servo motor and drive components usually leads to premature failure. In the present invention, however, this oscillation can be used to advantage to settle product introduced into the tube 20, just prior to activation of the sealing apparatus 22. In one form of the invention as illustrated in FIGS. 1 and 3, when a desired portion of product has been introduced into the tube 20, instability is induced in the pull belt axis by means of setting the P gain to cause oscillation for a brief segment of the machine cycle. This causes a high frequency vibration and results in very rapid settling of product in the tube 20 beneath the sealing system 22. During this time, the film continues to advance with a frequency oscillation providing settling while the film remains in continuous motion. Oscillation occurs about the commanded position point,>and so long as the commanded position continues to move, the oscillation occurs about a moving target value in an oscillation about a changing position point. Following the high frequency settling, the sealing system 22 can then be activated to seal and sever successive bags 24 from the film tube 20 in a conventional fashion.

In one manner of operating the form of the invention in FIG. 1, the measuring axis consisting of the measuring rolls 26 and 28 is driven as the master, with the pull axis, consisting of the pull belts 32 and 34, comprising the slave. In this form of the invention, the P gain of the measuring axis is adjusted to cause oscillation, and therefore the pull axis, as the slave, follows. The same, unstable high frequency vibration causes product to settle at a very rapid rate. In this case, since the pull belt axis is the slave, an instability generated by the measuring rolls must be significant enough to allow the pull belt axis to follow the movement of the master. While product settling occurs, this embodiment is not preferred, since it involves shaking the entire system rather than just the film tube.

In all forms of the invention, by increasing the P gain, the amplitude of oscillation, and therefore the severity of vibration imparted to the film tube 20, can be increased. Conversely, the P gain can be decreased, decreasing the amplitude and the severity of vibrations imparted to the film 20. The amplitude and duration of the instability introduced into the servo motor can be controlled depending on the nature of the product being settled.

Settling is shown schematically in FIGS. 4A through 4D. In these figures, the limit of the bottom of the heat seal provided by the sealing apparatus 22 is illustrated by a sealing line 54 which is illustrated for reference prior to actual sealing occurring. It will be understood that the sealing line 54 continues to move with the advancing film tube 20 as shaking takes place so that the product 56 is settled in the tube 20 before the sealing apparatus 22 is activated to close the sealing jaws to seal and sever the successive bags 24.

Figures 4A, 4B, 4C, 4D:
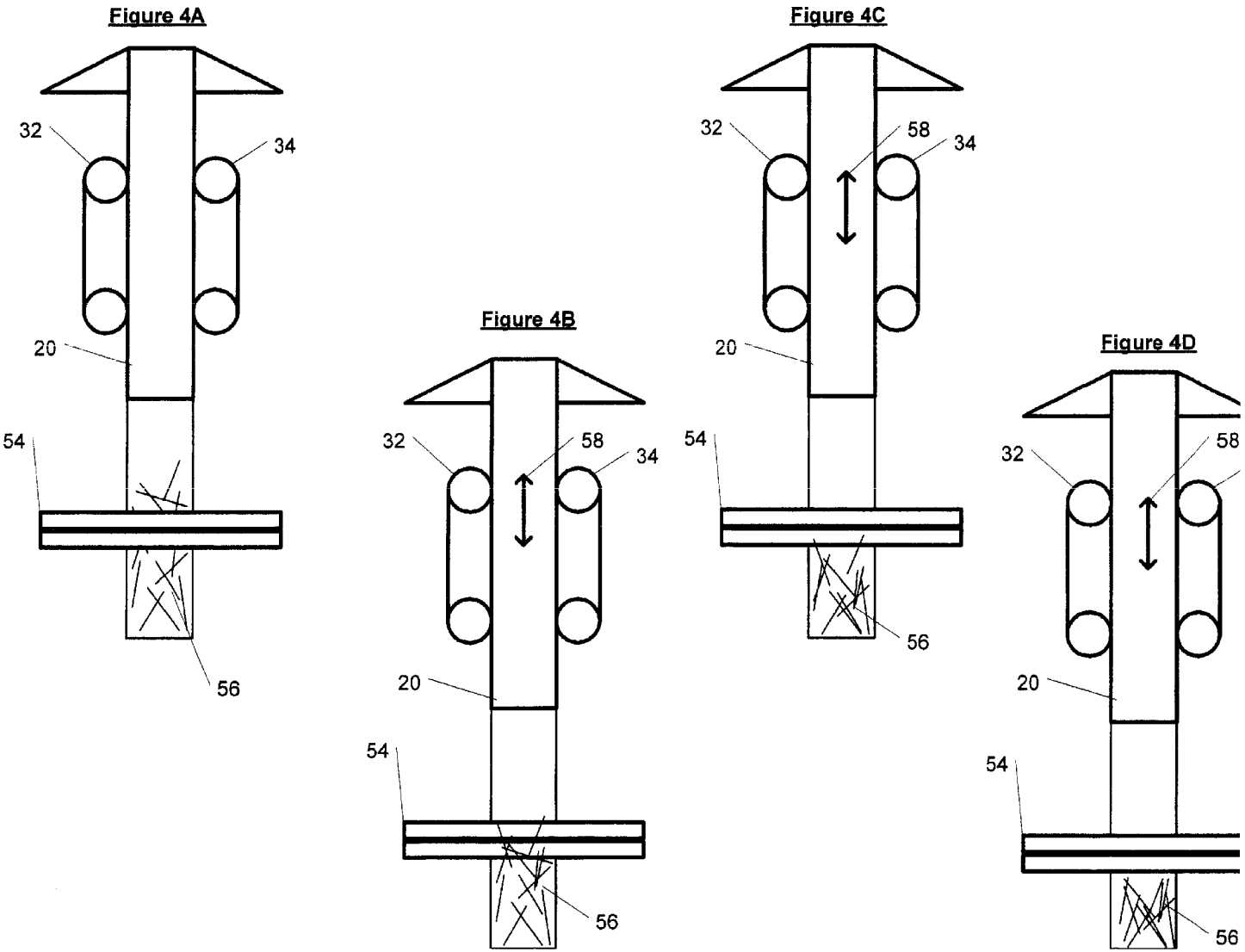
FIGS. 4A through 4D illustrate the unstable shaking of the invention for settling of product in the film tube.

In FIG. 4A, the product 56 to be packaged has just been introduced into the tube 20, and as illustrated, bridges against itself, extending well above the seal line 54. Should the sealing system 22 be closed at this time, the product located above the line 54 would be trapped in the sealing area, causing defective package end seals.

The instability condition begins in FIG. 4B, where the unstable oscillation commences in the pull belts 32 and 34, causing the tube 20 to oscillate up and down with the film tube 20 continuing to move in the downward direction, as schematically illustrated by the arrows 58 in FIGS. 4B through 4D. As the oscillation continues, the downward movement continues and the product 56 settles until, as shown in FIG. 4D, the product 56 is all situated beneath the line 54. At this point, the sealing apparatus is activated to seal and sever a package 24, and the process is then repeated.

Normally, introducing instability into a servo motor is very undesirable. In accordance with the invention, however, the introduced instability is used to advantage, and the high frequency vibration imparted to the film tube 20 causes product 56 to settle at a very rapid rate.

Various changes can be made to the invention without departing from the spirit thereof or scope of the following claims.

What is claimed is:

1. A method of settling product in a vertical form, fill and seal machine, the machine comprising a source of film, a forming shoulder for forming the film into a tube, a pull axis for conveying the tube, and a finishing system for sealing and severing successive completed packages from the tube, the method comprising the steps of a. operating the pull axis in a forward direction to continually pull the film, b. injecting a desired portion of product into the tube as the tube continues to advance, and c. inducing an instability in the pull axis for a predetermined period of time to produce rapid unstable oscillation and to shake the tube while the tube and the film continue to advance.

2. The method according to claim 1 including the further step, after the predetermined period of time, of activating the finishing system.

3. The method according to claim 1 in which the pull axis includes at least one servo motor, and method step "c" comprises setting gain of the servo motors to induce oscillation.

4. The method according to claim 3 including the step of increasing the gain to increase amplitude of the oscillation.

5. A method of settling product in a vertical form, fill and seal machine, the machine comprising a source of film, a measuring axis for conveying the film from the source and measuring an amount of the film on a continuous basis, a forming shoulder for forming the film into a tube, a pull axis for conveying the tube, and a finishing system for sealing and severing successive completed packages from the tube, the method comprising the steps of a. operating the measuring axis and the pull axis in a forward direction, while maintaining tension in the film and the tube, to pull film on a continuous basis, b. injecting a desired portion of product into the tube as the tube continues to advance, and c. inducing an instability in one of the axes for a predetermined period of time to produce rapid unstable oscillation and to shake the tube with the other of the axes remaining stable while the tube and the film continue to advance.

6. The method according to claim 5 including the further step, after the predetermined period of time, of activating the finishing system.

7. The method according to claim 6 in which the step of activating the finishing system includes moving the finishing system with the continuously advancing tube.

8. The method according to claim 5 in which the pull axis includes at least one servo motor, and method step "c" comprises setting gain of the servo motors to induce oscillation.

9. The method according to claim 8 including the step of increasing the gain to increase amplitude of the oscillation.

10. The method according to claim 8 in which the measuring axis includes a servo motor, and the method step "c" comprises setting only the gain of the servo motor for the pull axis.

11. The method according to claim 5 in which the measuring axis includes a servo motor and the pull axis includes a servo motor, with the measuring axis comprising a master axis and the pull axis comprising a slave axis, and method step "c" comprises setting only the gain of the servo motor for the measuring axis.

12. In a vertical form, fill and seal machine having a source of film, a forming shoulder for forming the film into a tube, a pull axis for conveying the tube, and a finishing system for sealing and severing successive completed packages from the tube, the machine including a drive for the pull axis for continuously pulling the film in a forward direction while a desired portion of product is injected into the tube, the improvement comprising means for inducing instability in the pull axis for a predetermined period of time to produce rapid unstable oscillation and to shake the tube while the tube and the film continue to advance.

13. A vertical form, fill and seal machine according to claim 12 in which the pull axis includes at least one servo motor, and said means for inducing instability comprises a gain control for said servo motors.

14. A vertical form, fill and seal machine according to claim 12 including a measuring axis for conveying the film from the source and measuring the film.

15. A vertical form, fill and seal machine according to claim 14 including a servo motor for operating said measuring axis.

16. A vertical form, fill and seal machine according to claim 12 including a servo motor for moving the finishing system with the continuously advancing tube.

* * * * *